US010167564B2

(12) United States Patent
Bokisa

(10) Patent No.: US 10,167,564 B2
(45) Date of Patent: Jan. 1, 2019

(54) APPARATUS AND METHODS OF MAINTAINING TRIVALENT CHROMIUM BATH PLATING EFFICIENCY

(71) Applicant: Coventya, Inc., Brooklyn Heights, OH (US)

(72) Inventor: George Bokisa, Brooklyn Heights, OH (US)

(73) Assignee: Coventya, Inc., Brooklyn Heights, OH (US)

( * ) Notice: Subject to any disclaimer, the term of this patent is extended or adjusted under 35 U.S.C. 154(b) by 326 days.

(21) Appl. No.: 14/760,349

(22) PCT Filed: Jan. 10, 2014

(86) PCT No.: PCT/US2014/011108

§ 371 (c)(1),
(2) Date: Jul. 10, 2015

(87) PCT Pub. No.: WO2014/110416

PCT Pub. Date: Jul. 17, 2014

(65) Prior Publication Data

US 2015/0354085 A1 Dec. 10, 2015

Related U.S. Application Data

(60) Provisional application No. 61/750,974, filed on Jan. 10, 2013.

(51) Int. Cl.

| | |
|---|---|
| ***C25D 3/06*** | (2006.01) |
| ***C25D 21/16*** | (2006.01) |
| ***C25D 21/18*** | (2006.01) |
| ***C25D 3/08*** | (2006.01) |

(52) U.S. Cl.
CPC ..... *C25D 3/06* (2013.01); *C25D 3/08* (2013.01); *C25D 21/16* (2013.01); *C25D 21/18* (2013.01)

(58) Field of Classification Search
CPC ..... C25D 3/06
See application file for complete search history.

(56) References Cited

U.S. PATENT DOCUMENTS

| | | | | |
|---|---|---|---|---|
| 5,196,109 | A * | 3/1993 | Scott | C25D 3/06 205/287 |
| 2004/0055889 | A1 | 3/2004 | Tran et al. | |
| 2013/0213813 | A1 * | 8/2013 | Hingley | C25D 3/06 205/81 |

FOREIGN PATENT DOCUMENTS

| | | | |
|---|---|---|---|
| DE | 19525509 | A1 | 1/1996 |
| DE | 10014260 | A1 | 9/2001 |
| DE | 102007040005 | A1 | 2/2009 |
| JP | S50-7732 | A | 1/1975 |

(Continued)

OTHER PUBLICATIONS

Machine translation of DE 19525509 of Clauberg, published 1996.*

(Continued)

*Primary Examiner* — Brian W Cohen
(74) *Attorney, Agent, or Firm* — Tarolli, Sundheim, Covell & Tummino LLP

(57) ABSTRACT

An apparatus for maintaining trivalent chromium plating bath efficiency includes an aqueous electroplating bath, which includes trivalent chromium ions and a sulfur compound, and an ultraviolet (UV) radiation source that provides UV radiation to the bath effective to inhibit a reduction in plating efficiency of the bath.

20 Claims, 2 Drawing Sheets

(56) References Cited

FOREIGN PATENT DOCUMENTS

| | | | | |
|---|---|---|---|---|
| JP | S50-60435 | A | 5/1975 | |
| KR | 100263317 | B1 | 8/2000 | |
| KR | 20030038475 | A | 5/2003 | |
| RU | 2015209 | C1 | 6/1994 | |
| WO | WO 2004107834 | A1 * | 12/2004 | ..... C25D 21/18 |

OTHER PUBLICATIONS

Extended European Search Report for Application No. 14738112.3-1373/2943601 dated Jul. 26, 2016.
Chinese Office Action dated Oct. 17, 2017.
EP Office Action for Application No. 14738112.3-1103, dated Jun. 22, 2018.

* cited by examiner

APPARATUS AND METHODS OF MAINTAINING TRIVALENT CHROMIUM BATH PLATING EFFICIENCY

RELATED APPLICATION

This application claims priority from U.S. Provisional Application No. 61/750,974, filed Jan. 10, 2013, the subject matter of which is incorporated herein by reference in its entirety.

BACKGROUND

Trivalent chromium plating solutions are used to produce deposits that have characteristics that approach that of hexavalent chromium solutions both in terms of color and corrosion resistance from an electrolyte that is much more environmentally friendly. In addition, trivalent chromium solutions can also be formulated to produce pleasing "dark" deposits. Such deposits are often referred to as "black" or "smoke", but for discussions purposes here will just be referred to as "dark". These "dark" deposits are generated from solutions of very like chemistries from those used to generate standard deposits, augmented with additives that are sulfur bearing compounds.

SUMMARY

Embodiments described herein relate to an apparatus for maintaining trivalent chromium plating bath efficiency. The apparatus can be used to electroplate an at least 10 microinches of thickness dark trivalent chromium deposit on a workpiece. The apparatus includes an electroplating bath, which comprises trivalent chromium ions and a sulfur compound, and an ultraviolet (UV) radiation source that provides UV radiation to the bath effective to inhibit a reduction in plating efficiency of the bath over time. The apparatus can further include a cathode workpiece in the bath and an anode contacting the bath. The electroplating bath provides a dark trivalent chromium coating on the cathode workpiece upon operation of the apparatus.

The sulfur compound provided in the electroplating bath can potentially reduce the plating efficiency of the bath, and the UV radiation can be provided to the bath at a wavelength and for a duration of time effective to inhibit a reduction in plating efficiency. In some embodiments, the UV radiation can be provided at a wavelength of about 400 nm to about 100 nm, about 300 nm to about 100 nm, or about 250 nm to about 150 nm to inhibit a reduction in plating efficiency.

In other embodiments, the apparatus can include an electroplating assembly in which at least a portion of the electroplating bath is contained and in which the cathode workpiece is electroplated. The apparatus can also include a UV treatment assembly that includes the UV radiation source. The UV treatment assembly can be in fluid communication with the electroplating assembly such that the electroplating bath flows from the electroplating assembly through the UV treatment assembly and back to the electroplating assembly. In some embodiments, flow of the electroplating bath through the UV treatment assembly and hence UV treatment is substantially continuous during electroplating of the cathode workpiece.

Other embodiments described herein relate to an apparatus for applying a dark trivalent chromium electroplate to a workpiece. The apparatus includes an electroplating bath, which comprises trivalent chromium ions and an a amount of sulfur compound effective to darken the trivalent chromium electroplate, and an ultraviolet (UV) radiation source that provides UV radiation to the bath effective to inhibit a reduction in plating efficiency of the bath during electroplating the workpiece. The apparatus can further include a cathode workpiece in the bath and an anode contacting the bath. The dark trivalent chromium electroplate applied to the workpiece can have a thickness of at least about 10 microinches.

The sulfur compound included in the electroplating bath can potentially reduce the plating efficiency of the bath, and the UV radiation can be provided to the bath at a wavelength and for a duration of time effective to inhibit a reduction in plating efficiency. In some embodiments, the UV radiation can be provided at a wavelength of about 400 nm to about 100 nm, about 300 nm to about 100 nm, or about 250 nm to about 150 nm to inhibit a reduction in plating efficiency.

In other embodiments, the apparatus can include an electroplating assembly in which at least a portion of the electroplating bath is contained and in which the cathode workpiece is electroplated. The apparatus can also include a UV treatment assembly that includes the UV radiation source. The UV treatment assembly can be in fluid communication with the electroplating assembly such that the electroplating bath flows from the electroplating assembly through the UV treatment assembly and back to the electroplating assembly. In some embodiments, flow of the electroplating bath through the UV treatment assembly is substantially continuous during electroplating of the cathode workpiece.

Still further embodiments, relate to a method for maintaining trivalent chromium plating bath efficiency. The method includes providing an electroplating bath, which comprises trivalent chromium ions and a sulfur compound. A cathode workpiece provided in the electroplating bath is then electroplated to produce a dark trivalent chromium electroplate on the cathode workpiece. The electroplating bath can be treated during and/or after electroplating the cathode workpiece with ultraviolet (UV) radiation effective to inhibit a reduction in plating efficiency of the bath over time.

In some embodiments, the sulfur compound included in the electroplating bath can potentially reduce the plating efficiency of the bath, and the UV radiation can be provided to the bath at a wavelength and for a duration of time effective to inhibit a reduction in plating efficiency. For example, the UV radiation can be provided at a wavelength of about 400 nm to about 100 nm, about 300 nm to about 100 nm, or about 250 nm to about 150 nm to inhibit a reduction in plating efficiency.

In other embodiments, at least a portion of the electroplating bath is contained in an electroplating assembly in which the cathode workpiece is electroplated and UV radiation is provided from a UV radiation source of a UV treatment assembly. The UV treatment assembly can be in fluid communication with the electroplating assembly such that the electroplating bath flows from the electroplating assembly through the UV treatment assembly and back to the electroplating assembly. Flow of the electroplating bath through the UV treatment assembly can be substantially continuous during electroplating of the cathode workpiece.

BRIEF DESCRIPTION OF THE DRAWINGS

The present invention and advantages thereof will become more apparent upon consideration of the following specification with reference to the accompanying drawings in which.

DETAILED DESCRIPTION

Figure 1:
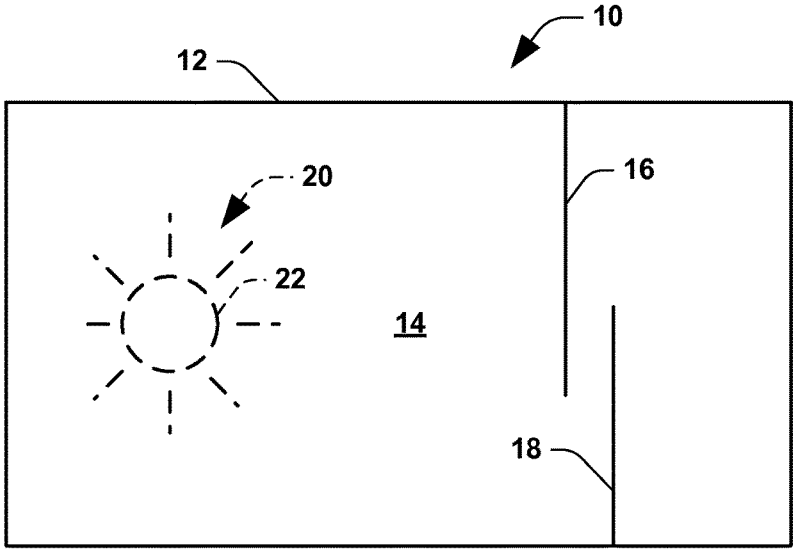
FIG. 1 is a schematic illustration of a trichromium electroplating apparatus in accordance with one embodiment.

Embodiments described herein relate to an apparatus and method for maintaining trivalent chromium plating bath efficiency as well as to an apparatus for applying a dark trivalent chromium electroplate to a workpiece. By "dark trivalent chromium electroplate", it is meant a trivalent chromium deposit that has a dark, black, or smoke-like hue and that is plated from a trivalent chromium electroplating bath or solution.

The apparatus includes an electroplating bath, which comprises trivalent chromium ions and an amount of sulfur compound effective to darken the trivalent chromium electroplate, and an ultraviolet (UV) radiation source that provides UV radiation to the bath effective to inhibit a reduction in plating efficiency of the bath during electroplating the workpiece.

Sulfur compounds provided in trivalent chromium electroplating baths to provide darkened trivalent chromium deposits tend to affect the plating baths such that the baths containing such sulfur compounds lose plating efficiency as baths age. With loss of efficiency comes a loss of plating thickness within a specified plating time period. Loss of plating thickness leads to a decrease in the deposit corrosion resistance to various environmental factors. And of course, loss of corrosion resistance means a decrease in the useful service life of whatever device was being chromium plated in the first place.

The simple solution is to merely increase the plating time to compensate for the loss of plating efficiency. While a workable solution on the small scale, this is not feasible for high production environments where automatic plating lines need to maintain as short a plating cycle as possible in order maintain high throughput.

Practical experience has shown, depending upon workload and solution volume, that after 4 to 6 months in operation that the plating efficiency can fall off in excess of 75%. Some fall off is inevitable, but maintaining a minimum thickness within a given time frame for longer periods would be desirable as partial or total solution replacements to regain plating efficiency is costly, both from new chemical expense as well as costs associated with proper disposal of the waste solution.

It was found that the deleterious effect of the sulfur compounds on trichromium plating bath efficiency can be inhibited or reduced by treating the bath with UV radiation for a duration effective to effective to inhibit a reduction in plating efficiency. Without wishing to be bound by theory, it is believed that sulfur from the sulfur compounds can infiltrate the a chromium coordination sphere during electroplating through a substitution reaction and render the chromium non-platable. The net effect of the sulfur complexed Cr is that the bath reacts as if the chromium concentration has dropped. UV radiation applied to the trichromium electroplating bath can potentially oxidize sulfur/sulfides/sulfites complexed with the chromium to sulfate without oxidizing trivalent chromium to the undesirable hexavalent state. This in turn can inhibit a reduction in trichromium plating bath efficiency that caused by the sulfur compounds.

FIG. 1 illustrates an electroplating apparatus 10 in accordance with one embodiment. The electroplating apparatus 10 comprises an electroplating assembly 12 that contains an aqueous trivalent chromium electroplating bath 14. The trivalent chromium electroplating bath 14 includes trivalent chromium ions and sulfur darkening compound that facilitates that deposition of a darkened trivalent chromium deposit upon electroplating. The electroplating assembly 12 can be in the form of a tank or container that is constructed of a suitable material, such as polypropylene or polyethylene.

A cathode workpiece 16 and an anode 18 are immersed in the electroplating bath 14. The cathode workpiece 16 can be any workpiece typically used in electroplating. Representative examples of substrates that can be used as the cathode workpiece and which can electroplated with trivalent chromium include various metals, such as engineering steel, carbon steels, stainless steels, and aircraft steels, aluminum and its alloys, copper and its alloys, molybdenum and its alloys, and nickel and its alloys. The cathode workpiece can have a variety of shapes, such as plate-like, rectangular, column-like, cylindrical and spherical shapes.

The anode 18 within the electroplating bath 14 can be made of a suitable material, such as carbon, platinized titanium, platinum, iridium oxide coated titanium, or tantalum oxide coated titanium. Soluble chromium anodes are generally unsuitable due to the build up of hexavalent chromium. However, for certain alloy plating it may be possible to use ferrous metal or chromium/iron anodes. The use of platinized titanium sheets permits conduction of chrome plating process without separation of the cathode and anode in separate chambers of the bath and eliminates anode oxidation of chromium III to chromium VI which inhibits plating process.

The material construction of the anode 18 is not restricted. For example, either an electrolytic coating or an electroless coating can be effectively employed on the anode 18. Practical considerations, such as cost and stability in a caustic solution will dictate the most suitable material for the anode.

In some embodiments, the anode 18 can be shaped according to the cathode workpiece/substrate 16, which is being plated to ensure even distribution of cathode current over the surface of the substrate. The cathode (substrate) 16 and anode 18 can be disposed within bath at a various distances relative to one another. Depending on dimensions and shape of the cathode workpiece 16, a suspension may be constructed and placed within the bath 14 and the cathode workpiece fixed thereto. Suspensions are typically constructed from stainless steel and obtained from the appropriate manufacturers.

The apparatus 10 also includes a UV treatment assembly 20, which includes a UV radiation source 22. The UV radiation source 22 emits UV radiation to the trichromium electroplating bath 14 at wavelength and concentration effective to substantially inhibit a reduction in plating efficiency potentially caused by the sulfur darkening compound during electroplating the cathode workpiece 16. By "substantially inhibiting" a reduction in plating efficiency, it is meant the UV radiation is applied to electroplating bath at a wavelength and duration effective to increase plating efficiency of the UV treated bath at least about 10%, at least about 15%, at least about 20%, at least about 25%, at least about 30%, at least about 35%, at least about 40%, at least about 45%, or at least about 50% compared to a similar trivalent chromium plating bath that is not UV treated.

The UV radiation source 22 can include a UV lamp that emits UV radiation within the UV spectrum. The UV radiation can be provided or emitted from the UV lamp at select or broad wavelengths within the UV spectrum to inhibit a reduction in plating efficiency. For example, the UV radiation can be emitted at a wavelength of about 400 nm to about 100 nm, about 300 nm to about 100 nm, or about 250 nm to about 150 nm to inhibit a reduction in plating efficiency. Advantageously, it was found that higher energy, short wavelength UV radiation less than 250 nm (e.g., 185 nm) applied to electroplating bath can more readily inhibit a reduction in plating efficiency of the bath compared to lower energy, longer wavelengths.

Figure 2:
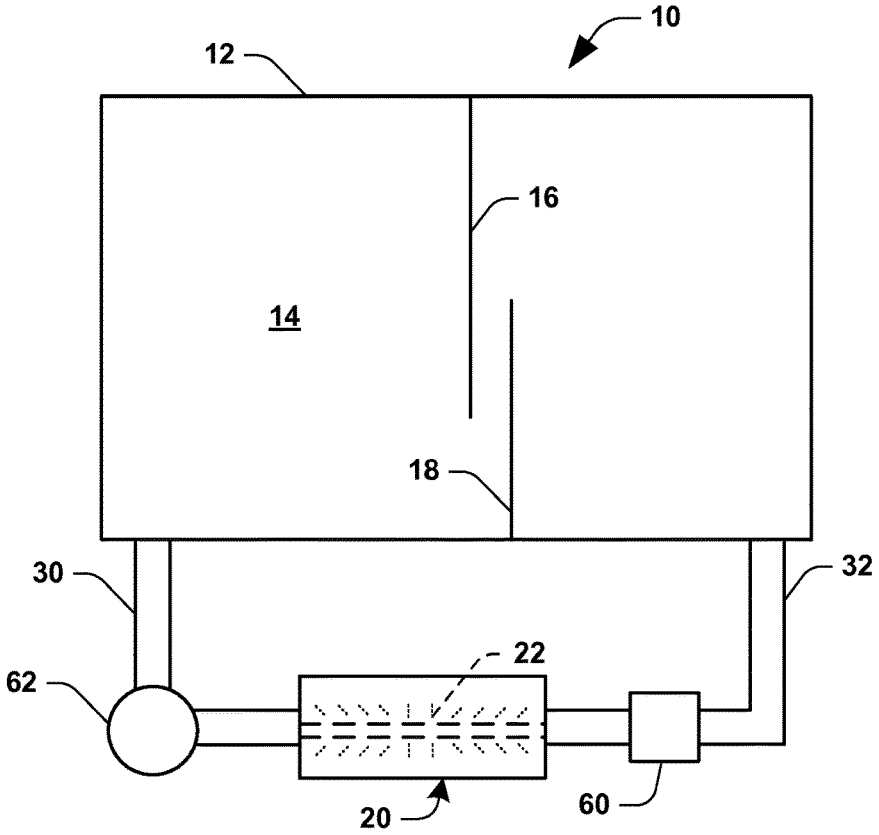
FIG. 2 is a schematic illustration of a trichromium electroplating apparatus in accordance with another embodiment.

The UV treatment assembly 20 can be provided in the electroplating assembly 12 to treat the trivalent chromium plating baths as shown schematically in FIG. 1. Alternatively, the UV treatment assembly 20 can be positioned external to the electroplating assembly 12 as illustrated schematically in FIG. 2. Referring to FIG. 2, the UV treatment assembly 20 can be in fluid communication with the electroplating assembly 12 such that the electroplating bath 14 flows through a first pipe 30 from the electroplating assembly 12 through the UV treatment assembly 20 and through a second pipe 32 back to the electroplating assembly 12.

Figure 3:
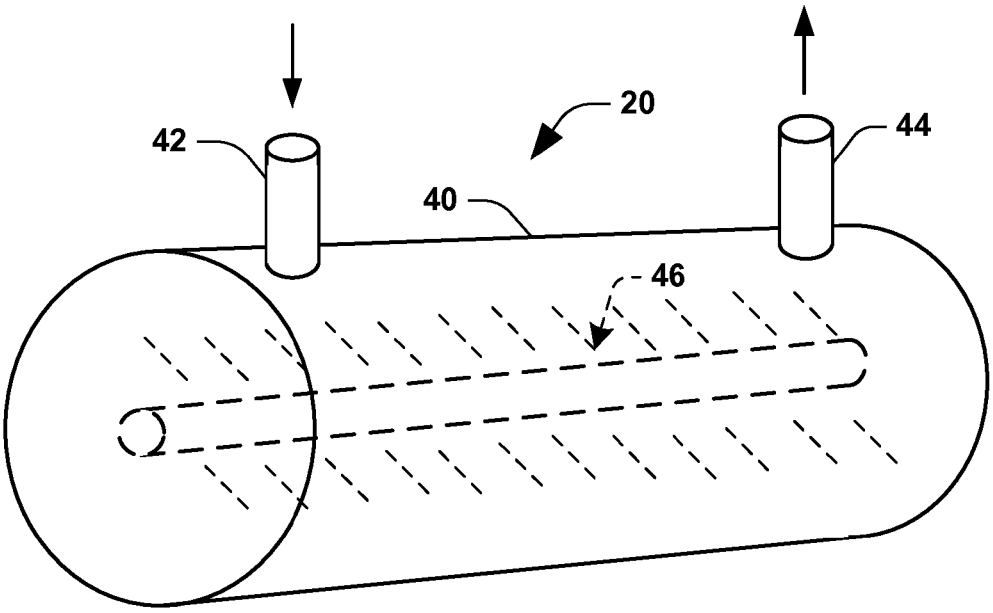
FIG. 3 is a schematic illustration of a UV treatment assembly in accordance with an embodiment.

In some embodiments, as illustrated in FIG. 3, the UV treatment assembly 20 can include a chamber tube 40, an inlet port 42 at a first end of the chamber tube 40, an outlet port 44 at a second end of the chamber tube 40, and an ultraviolet lamp 46 that extends axially through the chamber tube 40. Referring to FIG. 2 and FIG. 3, during operation, electroplating bath can flow from the electroplating assembly, through the first pipe 30 into the inlet port 42, through the chamber 40 and around the UV lamp 46 to receive UV radiation, out the outlet port 44, and through the second pipe 30 to the electroplating assembly 12. UV treatment assemblies have such configurations are commercially available from Atlantic Ultraviolet technologies.

The UV treatment assembly 20 can also be in fluid communication with a filter 60, which can remove impurities in the bath 14, as well as a pump 62, which can provide constant, continuous, or intermittent flow or circulation of the electroplating bath 14 through the first pipe 30, UV treatment assembly 20, filter 60, second pipe 32, and electroplating assembly 12, during electroplating of the cathode workpiece 16 to maintain plating efficiency of the bath 14.

It will be appreciated that the apparatus 10 can include more than one UV treatment assembly. For example, two or more UV treatment assemblies can be plumbed in series such that the electroplating bath is circulated through the two or more UV treatment assemblies prior to return to the electroplating assembly.

In some embodiments, the apparatus can also include a heating/cooling element (not shown) to regulate temperature of the bath as needed. For example, the bath can be equipped with a pipe made of stainless steel or the like disposed preferably at the bottom of the electroplating assembly to carry a water supply through the bath. The pipe serves as a heating element, when hot water is passed there through to heat the electrolyte solution as needed or as a cooling system when cold water is passed there through to cool the electrolyte solution as needed. A temperature controller disposed within the bath monitors the hot and cold water supply rate to regulate the electrolyte temperature.

The aqueous trivalent chromium bath 14 provided in the electroplating apparatus 10 contains a controlled amount of trivalent chromium ions. The source of trivalent chromium ions for the electroplating bath can be any trivalent chromium containing substance. The trivalent chromium-containing substance can include one or more of trivalent chromium and water-soluble substances containing trivalent chromium. A source material for the trivalent chromium-containing substance is a water-soluble compound capable of forming trivalent chromium in water, which may be referred to as a water-soluble trivalent chromium compound.

Examples of a water-soluble trivalent chromium compound include salts of trivalent chromium, such as chromium chloride, chromium sulfate, chromium nitrate, chromium phosphate, and chromium acetate, and compounds obtained by reducing hexavalent chromium compounds such as chromic acid and bichromates. The water-soluble trivalent chromium compound may include of one species or of two or more species. In some embodiments, the water-soluble trivalent chromium compound can include chromium chloride and chromium nitrate. Since hexavalent chromium compounds are not intentionally added as source materials to the electroplating bath, in at least some embodiments, the electroplating bath as described herein does not substantially contain hexavalent chromium.

The trivalent chromium bath may include bromide, formate (or acetate) and any borate ion which may be present, as the sole anion species. Typically the bath contains only sufficient bromide to prevent substantial formation of hexavalent chromium, sufficient formate to be effective in complexing the chromium, and sufficient borate to be effective as a buffer, the remainder of the anions required to balance the cation content of the bath comprising cheaper species such as chloride and/or sulfate.

The trivalent chromium bath may also contain halide ions, in addition to bromide such as fluoride or, such as, chloride as well as some sulfate ions in a minor proportion based on the halide. The total amount of halide including the bromide and any iodide which may be present as well as any fluoride, and/or chloride, may optionally be sufficient, together with the formate and any borate to provide essentially the total anion content of the bath. The bath may also contain the cations of the conductivity salts, and of any salts used to introduce the anion species. Optional ingredients include ammonium and co-depositable metals, such as iron, cobalt, nickel, manganese and tungsten. Non co-depositable metals may also optionally be present. Surface active agents and antifoams may also be present in effective and compatible amounts.

The content of the trivalent chromium ions in the electroplating bath can be at least 1 g/L. There is no limitation on the upper limit of the content of the trivalent chromium-containing substance. The content can be, for example, up to 250 g/L from the viewpoint of high economic efficiency and easy waste treatment. In some embodiment, the concentration of the trivalent chromium ion in the electroplating bath is from about 1 g/L to about 50 g/L.

The sulfur darkening compound that is provided in the electroplating bath can include any sulfur compound that can facilitate formation of dark-hued trivalent chromium deposit on the cathode workpiece. Examples of sulfur compounds include sulfurous acid and sulfite, disulfurous acid and disulfite, and an organic or inorganic compound containing a —SH (mercapto group), —S-(thioether group), >C═S (thioaldehyde group, thioketone group), —COSH (thiocarboxy group, —CSSH (dithiocarboxy group), —$CSNH_2$ (thioamide group), —$SSO_3$ (thiosulfate), and/or —SCN (thiocyanate group, isocyanate group). Examples of such an organic or inorganic compound include ammonium thioglycolate, thioglycolic acid, thiomaleic acid, thioacetamide, dithioglycolic acid, ammonium dithioglycolate, ammonium dithiodiglycolate, dithiodiglycolic acid, cysteine, saccharin, thiamine nitrate, sodium N,N-diethyl-dithiocarbamate, 1,3-diethyl-2-thiourea, N-thiazole-2-sulfuramylamide, 1,2,3-benzotriazole, 2-thiazolin-2-thiol, thiazole, thiourea, thiozole, sodium thioindoxylate, o-sulfonamidobenzoic acid, sulfanilic acid, orange-II, methyl orange, naphthionic acid, naphtalene-alpha-sulfonic acid, 2-mercaptobenzothiazole, 1-naphthol-4-sulfonic acid, Schaeffer's acid (6-hydroxy-2-Naphthalenesulfonic acid), sulfadiazine, sodium thiosulfate, ammonium thiocyanate, potassium thiocyanate, sodium thiocyanate, rhodanine, ammonium sulfide, sodium sulfide, ammonium sulfate, thioglycerin, thioacetic acid, potassium thioacetate, thiodiacetic acid, 3,3-thiodipropionic acid, and thiosemicarbazide.

In some embodiments, the content of the sulfur compound is can be from about 0.1 g/L to about 10 g/L. When the content is less than 0.1 g/L, it can become difficult for the effect of blackening or darkening of deposit. When the content is more than 10 g/L, the effect becomes saturated.

The electroplating bath can also contain one or more compounds selected from the group consisting of metal ions, an organic acid and an anion of the organic acid, an inorganic acid and an anion of the inorganic acid, an inorganic colloid, a silane coupling agent, a nitrogen compound, and a fluorine compound. The electroplating bath can further contain one or more compounds selected from the group consisting of a polymer such as a wax, a corrosion inhibitor, a surfactant such as a diol, a triol, and an amine, a plastic dispersive material, a colorant, a pigment, a pigment-producing agent such as a metal pigment-producing agent, a desiccant, and a dispersant. The electroplating bath may further contain a chemical substance such as a polyphenol capable of reducing the amount of eluted hexavalent chromium from a in the bath.

Examples of a metal ion include ions of Ni, Na, K, Ag, Au, Ru, Nb, Ta, Pt, Pd, Fe, Ca, Mg, Zr, Sc, Ti, V, Mn, Cu, Zn, Sn, Y, Mo, Hf, Te, and W.

Examples of an organic acid include a monocarboxylic acid, such as formic acid, acetic acid, and propionic acid; a dicarboxylic acid, such as oxalic acid, malonic acid, succinic acid, glutaric acid, adipic acid, pimelic acid, suberic acid, azelaic acid, sebacic acid, maleic acid, phthalic acid, and terephthalic acid; a tricarboxylic acid such as tricarballylic acid; a hydroxycarboxyl acid, such as glycolic acid, lactic acid, malic acid, tartaric acid, citric acid, and ascorbic acid; and an aminocarboxylic acid, such as glycine and alanine.

Examples of an inorganic acid include a halogen acid, such as hydrochloric acid, hydrofluoric acid, and hydrobromic acid, chloric acid, perchloric acid, chlorite acid, hypochlorous acid, sulfuric acid, sulfurous acid, nitric acid, and nitrous acid. Inorganic acids containing phosphorus, such as phosphoric acid (orthophosphoric acid), polyphosphoric acid, metaphosphoric acid, pyrophosphoric acid, ultraphosphoric acid, hypophosphorous acid, and perphosphoric acid may be contained.

Examples of an inorganic colloid include a silica sol, an alumina sol, a titanium sol, and a zirconium sol. Examples of a silane coupling agent include vinyltriethoxy silane and gamma-metacryloxypropyltrimethoxy silane.

Examples of a nitrogen compound include organic nitrogen compounds such as heterocyclic compounds such as pyrrole, urea compounds, aliphatic amines, acid amides, aminocarboxylic acids, amines, and nitrobenzenesulfonic acid; and inorganic nitrogen compounds such as urea, ammonium salts, and nitrates.

The aqueous trivalent chromium plating bath can also include other solvents besides water. For example, from the viewpoint of improving the solubility of components of the electroplating bath, the electroplating bath may contain an organic solvent which is soluble in water, such as alcohols, ethers, and esters. There is no limitation on the ratio of the amount of the contained organic solvent to the total amount of the solvent. From the viewpoint of easy effluent treatment, the ratio is preferably at most 10% by weight.

The pH of the electroplating bath can vary as long as the electroplating bath is acidic. In some embodiments, the pH of the electroplating bath can be from about 1 to about 4. At low pH values (below 2) there is some loss of covering power which becomes unacceptable below pH 1. If the pH is above 4 the rate of plating tends to be undesirably slow. In other embodiments, the pH of the electroplating bath can be from about 2 to about 3 to enhance the stability of the electroplating bath. The pH of the electroplating bath may be adjusted by adding alkaline substances such as sodium hydroxide, sodium hydrogen carbonate, and ammonia; and/or acidic substances such as sulfuric acid, nitric acid, and hydrochloric acid.

The dark trivalent chromium deposit is typically electroplated on the cathode work piece at temperatures between about 15° C. and about 65° C. Current densities used to electroplate the dark trivalent chromium deposit on the cathode workpiece can between about 5 amps/ft$^2$ and about 1000 amps/ft$^2$, for example, between about 50 amps/ft$^2$ to 200 amps/ft$^2$.

During operation of the electroplating apparatus 10, the electroplating assembly 12 can be filled with a desired amount of trivalent chromium electroplating bath and the heating element can be turned on. When the desired operational temperature is reached, the cathode workpiece 16 can be provided in the electroplating bath 14 by, for example, hanging the cathode workpiece 16 on cathode suspension bar or basked in the electroplating assembly 12. Precipitation current can then be applied to the cathode workpiece 16 effective to electroplate the dark trivalent chromium electroplate on the workpiece 16.

The electroplating bath 14 can be pumped or circulated continuously through the UV treatment assembly 20 during operation of the electroplating apparatus 10 to potentially inhibit buildup of sulfur/chromium complexes and mitigate and/or inhibit a reduction in plating efficiency. The filter 60 can also remove possible impurities in the bath. The speed or rate of circulation can be determined based on the volume of the bath as well as the potential generation of buildup of impurities that can affect plating efficiency, the consistency of the electroplate, and/or appearance of the electroplate. Chromium salts and pH regulating bases can also be introduced into the bath to maintain adequate chromium levels and pH.

Advantageously, the apparatus described herein can apply a dark trivalent chromium electroplate a workpiece at a substantially uniform thickness of at least about 10 microinches with minimal loss in plating efficiency during application of the electroplate. The life of the electroplating bath can be extended for over 10 months with only the addition of spent components.

The present invention is further illustrated by the following examples. These examples show the advantages of using membrane anode enclosures in alkaline zinc and zinc-alloy plating baths. These examples are provided for illustration and are not to be construed as limiting the scope or content of the invention in any way.

Example 1

In this Example, it is shown that there is drop in plating efficiency between new and used dark trivalent chromium baths. Thickness values, as determined by X-ray Fluorescence, were used on various dark trivalent chromium plating baths through controlled Hull Cell panel testing. Hull Cell testing is well known and trivial to those skilled in the plating arts. Thickness (microinches) was determined at a variety profiles at 120 and 90 ASF from panels produced at 30° C. on 3 Amp, 5 minute, mechanically agitated, 267 ml polished brass Hull Cell Panels.

A comparison was made between new and used solutions used to produce standard as well as darkened finishes.

| Sample/Finish | Thickness (μ inch) @ 120 ASF | Thickness (μ inch) @ 90 ASF |
|---|---|---|
| "New"/Dark | 35 | 20 |
| "Used"/Dark | 10 | 7 |
| "New"/Standard | 45 | 40 |
| "Used"/Standard | 50 | 45 |

A bath is considered useful if it can produce in excess of 10 microinches of deposit thickness at 120 ASF, and better 90 ASF, using the plating parameters described.

The testing clearly shows the thickness fall off due to the efficiency loss between and new and used solutions used to produce "dark" deposits and the stability of baths that produce standard appearance deposits. It is also worth noting that the loss of efficiency does not necessarily impact the deposit appearance, but rather only corrosion resistance.

Example 2

When faced with a drop of plating efficiency using a dark trivalent chromium plating solution, typically the only viable solution is to replace the solution. It was found that only solutions that produce "dark" deposits tend to suffer from the issues. Standard trivalent chromium baths run years without loss of efficiency. The basic chemistries of trivalent chromium baths and dark trivalent chromium baths are the same with the exception that the trivalent chromium baths producing dark deposits typically use an extra sulfur containing compound as a darkening agent. Often the darkening agent contains a thiosulfate or thiocyanate moiety. Additions of these compounds have an immediate effect of reducing the plating efficiency about 25%, but the efficiency continues to decrease during use even though the amount of darkening agent is analyzed for and maintained at a constant concentration.

This Example describes an investigation as to whether there is a deleterious breakdown product from the darkening additive that hinders plating efficiency as it builds in solution during operation. Addition of either thiocyanate or thiosulfate to a freshly made "dark" trivalent chromium bath does in fact negatively impact the efficiency. Testing has shown that it is the nascent sulfur that tends to be the poison that builds up. This is illustrated by the following chart that shows the effect of sodium thiosulfate additions to 250 ml of freshly made "dark" trivalent chromium baths and how its build-up impedes efficiency:

| Sample | Thickness (μ inch) @ 120 ASF | Thickness (μ inch) @ 90 ASF | Thickness (μ inch) @ 60 ASF |
|---|---|---|---|
| New "Dark" | 35 | 20 | 10 |
| New + 1 gm thiosulfate | 30 | 16 | 7 |
| New + 5 gm thiosulfate | 22 | 12 | 5 |
| New + 10 gm thiosulfate | 17 | 9 | 4 |
| New + 20 gm thiosulfate | 10 | 8 | 4 |

It is the build up of the nascent sulfur that makes partial bath replacement difficult. Not wishing to be bound by theory, it is postulated that the "thio" sulfur is liberated as a breakdown product into the solution, regardless of being added as either a thiocyanate or thiosulfate (or other possible thio compounds). It is also worth noting that the sulfur associated with the sulfate moiety is not a poison and does not impact the efficiency. Slowly, during bath operation at 30° C., the free sulfur infiltrates the chromium coordination sphere through a substitution reaction and renders the chromium non-platable. But, since the chromium analysis is done by Atomic Absorption Spectroscopy, the procedure does not differentiate between chromium that can be plated and that which has been rendered inert. The net effect of the sulfur complexed chromium is that the bath reacts as if the chromium concentration has dropped. It then follows the standard cause and effect; low metal, lower efficiency. To confirm, more chromium was added to a "poisoned" solution as chromium sulfate to in effect take the place of chromium that was complexed with the sulfur and no longer available for plating. The increase in chromium ion concentration immediately caused a jump in plating efficiency, yielding improved deposit thickness. While this can be done short term, this is not a viable long term solution as ultimately bath solubility will be exceeded and salting out of the electrolyte is inevitable.

Example 3

Further confirmation of the contamination mechanism and the need for a method to break the undesirable complex was revealed through the tracking of a partial bath replacement. Knowing that contamination takes place, a non-viable bath was cut in half and reconstituted with fresh chemistry. Again, an immediate increase in the efficiency was noted, however, the bath chromium complexes are unstable when freshly made and a standard step is to heat the solution to 60° C. for 45 minutes to put the chromium into the desired complex for most effective plating prior to cooling to the standard 30° C. operating temperature. This is a most desirable step when first putting a bath into operation, however, when using a contaminated solution, the temperature increase allows for the nascent sulfur to enter the chromium coordination sphere and preferentially yield the poisoned complex. The efficiency gained from the cut is immediately lost.

| Sample | Thickness (μ inch) @ 120 ASF | Thickness (μ inch) @ 90 ASF | Thickness (μ inch) @ 60 ASF |
|---|---|---|---|
| Non viable Dark solution | 8 | 7 | 7 |
| 50% cut and remake | 14 | 12 | 8 |
| Heat for Complex formation | 9 | 9 | 8 |

Such a "fix" would have come with half the cost of a new bath make-up and yielded no practical bath life extension.

Example 4

Normal contamination issues with plating solutions are solved by some combination of either carbon purification for organic contaminants, anion resin treatments for removal of metallic contaminants, dummy plating for destruction of organic species along with deposition of offending metallic species, or ratio decants to lower contaminants to acceptable levels. None of the approaches is successful in eliminating the sulfur responsible for the efficiency loss. In fact, dummy plating exasperates the problem by making more of the breakdown products. Another possible alternative is oxidation of the contaminant sulfur to a species that is amenable to removal by one of the other methods. The problem in this case is that most chemical oxidants that are strong enough to oxidize sulfur/sulfides/sulfites to sulfate are also strong enough to oxidize trivalent chromium to the undesirable hexavalent state. One problem cannot be solved by creating a more environmentally undesirable one.

It was found that undesirable sulfur contamination can be inhibited by oxidizing the undesirable sulfur through photochemical means using ultraviolet radiation. In this Example, multiple passes of 10 liters of non-viable "dark" solution were made through an approximately one foot long UV purification cell for water purification commercially available from Atlantic Ultraviolet Technology. UV purification cell included a chamber tube, an inlet port at a first end of the chamber tube, an outlet port at a second end of the chamber tube, and an ultraviolet lamp that extending axially through the chamber tube.

Of course, for this application, the trivalent chromium plating bath was cycled through the chamber rather than water. Both UV radiation at a wavelength of 254 nm and 180 nm were tested. Sampling for efficiency recovery was done after 72 and 144 hours of circulation. Results as follows:

| Sample | Thickness (μ inch) @ 120 ASF | Thickness (μ inch) @ 90 ASF | Thickness (μ inch) @ 60 ASF |
|---|---|---|---|
| Non viable Dark solution | 10 | 7 | 6 |
| 254 nm - 72 hours | 12 | 10 | 7 |
| 254 nm - 144 hours | 13 | 11 | 7 |
| 185 nm - 72 hours | 13 | 11 | 7 |
| 185 nm - 144 hours | 17 | 15 | 10 |

The higher energy, shorter wavelength 185 nm increased the efficiency greater than 50% in the higher current densities. It is clear that either the high energy causes the sulfur to be driven from the chromium coordination compound or converts it to benign sulfate. Regardless of the mechanism, the result is unequivocal. Short wavelength UV treatment of the solution can regenerate the solution and yield a solution that can once again deliver more than adequate deposit thickness in the desired time frame.

Example 5

In this Example, two similar UV purification cells (commercially available from Atlantic Ultraviolet Technology) of 5 foot length were plumbed in series with the filtration system on a 340 gallon production tank for testing purposes. A new dark trivalent chromium bath was built and the bath continually circulated through the bath life extension set-up. The bath achieved over 10 months of production and is still producing deposits on test panels with 12-13 and 10-11 microinches of thickness at 120 and 90 ASF locations respectively.

From the above description of the invention, those skilled in the art will perceive improvements, changes and modifications. Such improvements, changes and modifications within the skill of the art are intended to be covered by the appended claims. All patents and publications cited herein are incorporated by reference in their entirety.

Having described the invention, I claim:

1. A method for maintaining trivalent chromium plating bath efficiency, the method comprising:

providing an aqueous electroplating bath that includes trivalent chromium ions and a sulfur compound;

electroplating a cathode workpiece provided in the electroplating bath to produce a darkened or black trivalent chromium electroplate on the cathode workpiece; and continuously treating the electroplating bath during electroplating the cathode workpiece with ultraviolet (UV) radiation effective to inhibit a reduction in plating efficiency of the bath over time, wherein the treating step does not include administration of a chemical oxidant to the electroplating bath and does not oxidize the trivalent chromium to hexavalent chromium.

2. The method of claim 1, wherein the UV radiation is provided at a wavelength of about 300 nm to about 100 nm.

3. The method of claim 1, wherein the sulfur compound reduces the plating efficiency of the bath and the UV radiation is provided to the bath at a wavelength and for a duration of time effective to inhibit a reduction in plating efficiency.

4. The method of the claim 1, wherein at least a portion of the electroplating bath is contained in an electroplating assembly in which the cathode workpiece is electroplated; and UV radiation is provided from a UV radiation source of a UV treatment assembly.

5. The method of claim 4, wherein the UV treatment assembly is in fluid communication with the electroplating assembly such that the electroplating bath flows from the electroplating assembly through the UV treatment assembly and back to the electroplating assembly.

6. The method of claim 5, wherein flow of the electroplating bath through the UV treatment assembly is substantially continuous during electroplating of the cathode workpiece.

7. The method of claim 1, wherein the electroplating bath produces at least 10 microinches of electroplate thickness on the cathode workpiece during operation.

8. The method of claim 1, wherein the sulfur compound is a thiocyanate or thiosulfate sulfur compound.

9. The method of claim 1, wherein the electroplating bath is treated with UV radiation having a wavelength of 185 nm.

10. The method of claim 1, wherein the electroplating bath has a pH of about 1 to about 4.

11. The method of claim 1, wherein the darkened or black trivalent chromium electroplate is electroplated on the cathode workpiece at temperatures between about 15° C. and 65° C. and at 50 amps/ft$^2$ to 200 amps/ft$^2$.

12. A method for maintaining trivalent chromium plating bath efficiency, the method comprising:

providing an aqueous electroplating bath that includes trivalent chromium ions and a thiocyanate or thiosulfate sulfur compound;

electroplating a cathode workpiece provided in the electroplating bath to produce a darkened or black trivalent chromium electroplate on the cathode workpiece; and continuously treating the electroplating bath during electroplating the cathode workpiece with ultraviolet (UV) radiation effective to inhibit a reduction in plating efficiency of the bath over time, wherein the treating step does not include administration of a chemical oxidant to the electroplating bath and does not oxidize the trivalent chromium to hexavalent chromium.

13. The method of claim 12, wherein the sulfur compound reduces the plating efficiency of the bath and the UV radiation is provided to the bath at a wavelength and for a duration of time effective to inhibit a reduction in plating efficiency.

14. The method of the claim 12, wherein:

at least a portion of the electroplating bath is contained in an electroplating assembly in which the cathode workpiece is electroplated; and UV radiation is provided from a UV radiation source of a UV treatment assembly.

15. The method of claim 14, wherein the UV treatment assembly is in fluid communication with the electroplating assembly such that the electroplating bath flows from the electroplating assembly through the UV treatment assembly and back to the electroplating assembly.

16. The method of claim 15, wherein flow of the electroplating bath through the UV treatment assembly is substantially continuous during electroplating of the cathode workpiece.

17. The method of claim 12, wherein the electroplating bath produces at least 10 microinches of electroplate thickness on the cathode workpiece during operation.

18. The method of claim 12, wherein the electroplating bath is treated with UV radiation having a wavelength of 185 nm.

19. The method of claim 12, wherein the electroplating bath has a pH of about 1 to about 4.

20. The method of claim 12, wherein the darkened or black trivalent chromium electroplate is electroplated on the cathode workpiece at temperatures between about 15° C. and 65° C. and at 50 amps/$ft^2$ to 200 amps/$ft^2$.

* * * * *